United States Patent [19]

Olmsted

[11] Patent Number: 4,724,672

[45] Date of Patent: Feb. 16, 1988

[54] ENERGY STORING HYDRAULIC LIFT PUMP FOR OIL WELLS

[76] Inventor: Peter B. Olmsted, 12730 Peninsula Dr., Traverse City, Mich. 49684

[21] Appl. No.: 877,490

[22] Filed: Jun. 23, 1986

[51] Int. Cl.[4] ..... F16D 31/02

[52] U.S. Cl. ..... 60/371; 60/414

[58] Field of Search ..... 60/413, 414, 371

[56] References Cited

U.S. PATENT DOCUMENTS

| | | | |
|---|---|---|---|
| 2,276,358 | 3/1942 | Vickers | 60/371 X |
| 4,018,052 | 4/1977 | Laussermair | 60/414 |
| 4,646,518 | 3/1987 | Hochsattel | 60/413 |

*Primary Examiner*—William E. Wayner

*Attorney, Agent, or Firm*—James M. Deimen

[57] ABSTRACT

A motor driven hydraulic lift pump assembly for oil wells includes a mechanical flywheel connected to a hydraulic pump/motor combination in turn incorporated in the hydraulic circuit of the well lift cylinder. The pump/motor and flywheel assembly with associated hydraulic control can be separately mounted on a skid and connected into the hydraulic and electrical circuitry for the well lift cylinder. The combination pump/motor reverses in mode as the vertically mounted well cylinder piston moves upwardly and downwardly to pump from a deep well. As the well cylinder piston moves downwardly the pump/motor is in motor mode storing energy by increasing the rotational speed of the flywheel. As the well cylinder piston moves upwardly the pump/motor is in the pump mode and energy is taken from the flywheel to assist in raising the well cylinder piston to pump crude oil from the deep well. Thus, a portion of the energy released as the well cylinder piston moves downwardly on the return stroke is saved in the flywheel and recycled to assist in raising the well cylinder on the pumping stroke.

8 Claims, 6 Drawing Figures

ENERGY STORING HYDRAULIC LIFT PUMP FOR OIL WELLS

BACKGROUND OF THE INVENTION

The field of the invention is deep well pumping wherein a mechanism is provided at the top of the well which supports and drives a long pump rod extending down the well pipe to a driven reciprocating piston and valve mechanism at or near the bottom of the well. Each stroke of the rod lifts a quantity of oil or other fluid out of the top of the well equal to the volumetric displacement of the driven piston per stroke. On the return stroke the valve at the bottom of the well opens to permit more oil or other fluid to enter above the driven piston. On each pump stroke the entire column of oil in the well pipe is lifted by the rod and driven piston at the bottom of the well.

The pump rod may be vertically reciprocated mechanically as has been done with rocking beam lift pumps for many years or may be vertically reciprocated with a large hydraulic cylinder and piston located at the top of the well. The hydraulic cylinder lift pump is a more recent device. A hydraulic lift pump assembly typically comprises a large vertically mounted hydraulic well lift cylinder placed directly over the well pipe with the cylinder piston rod connected to the pump rod extending down the well pipe. Adjacent and below the well cylinder is a gas engine or electrically driven hydraulic pump.

The hydraulic pump in the pumping mode supplies high pressure hydraulic fluid to the lift cylinder to raise the piston. The hydraulic pump is then shifted to the non-pumping mode and the high pressure flow to the well cylinder stopped thereby allowing the well cylinder piston and the pump rod to fall. An orifice in the lift cylinder supply line prevents free fall of the pump rod on the return stroke.

The pump rod and column of oil contained within the well pipe store a significantly large amount of potential energy as the well cylinder piston moves upwardly on the pump stroke. This stored energy is lost on the return stroke. With a view toward retrieving as much of the lost energy on the return stroke as possible to thereby increase the overall efficiency of the hydraulic well pump system, applicant has developed the energy storage apparatus described below.

SUMMARY OF THE INVENTION

The invention comprises a heavy flywheel mechanically attached to a hydraulic combined pump/motor that in turn is connected into the lift and return headers of the hydraulic circuit to the well lift cylinder. The flywheel pump/motor combination and hydraulic control can be a separate assembly that is electrically and hydraulically connected to the well lift cylinder and hydraulic pump apparatus. In the preferred embodiment the flywheel rotates at up to approximately 3,000 RPM, slowing down and speeding up with each complete pumping cycle of the well cylinder. On the return stroke of the well cylinder, the pump/motor is in the motor mode thereby storing energy in the flywheel by permitting the falling well cylinder piston, pump rod and column of oil to hydraulically drive the pump/motor. On the pumping stroke of the well cylinder, the pump/motor combination is in the pump mode and energy from the rotating flywheel is retrieved to assist in providing high pressure hydraulic fluid to lift the well cylinder piston.

A further object of the energy storing lift pump is to control and adjust the cycle time for the return stroke. If the volumetric displacement of the driven piston is not completely filled with crude oil during the return stroke, then shock loading is applied to the pump rod, driven piston and well lift cylinder. To prevent shock loading from being applied to the assembly, either the stroke of the well lift cylinder can be shortened or preferably the flow rate of hydraulic fluid from the well lift cylinder slowed on the return stroke. In the preferred embodiment the volumetric displacement per revolution of the pump/motor and engine driven pump are adjusted to control the flow rate of fluid from the well lift cylinder, thereby controlling the cycle time of the return stroke.

Although the specific embodiment of the flywheel pump/motor combination herein disclosed is applied to an oil well lift pump, the flywheel pump/motor combination may also be utilized as an energy storing and supplying means for heave accummulators on offshore drill ships and floating derricks.

DESCRIPTION OF THE PREFERRED EMBODIMENTS

Figures 1A, 5:
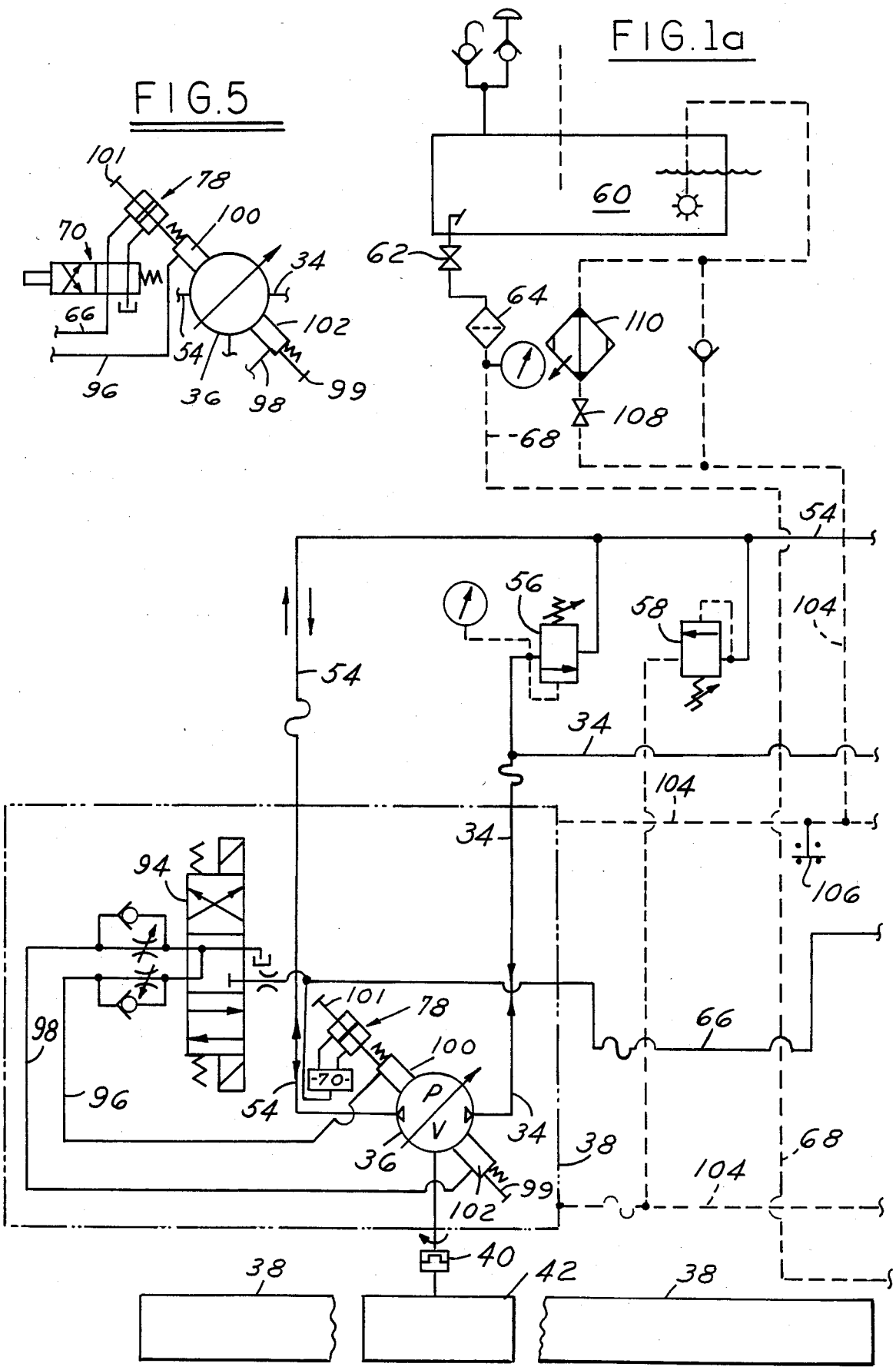
FIGS. 1*a* and 1*b* are a complete hydraulic schematic of the improved hydraulic lift pump for an oil well.
FIG. 5 is a detailed schematic of the limit stop control on the pump/motor.
Figure 1B:
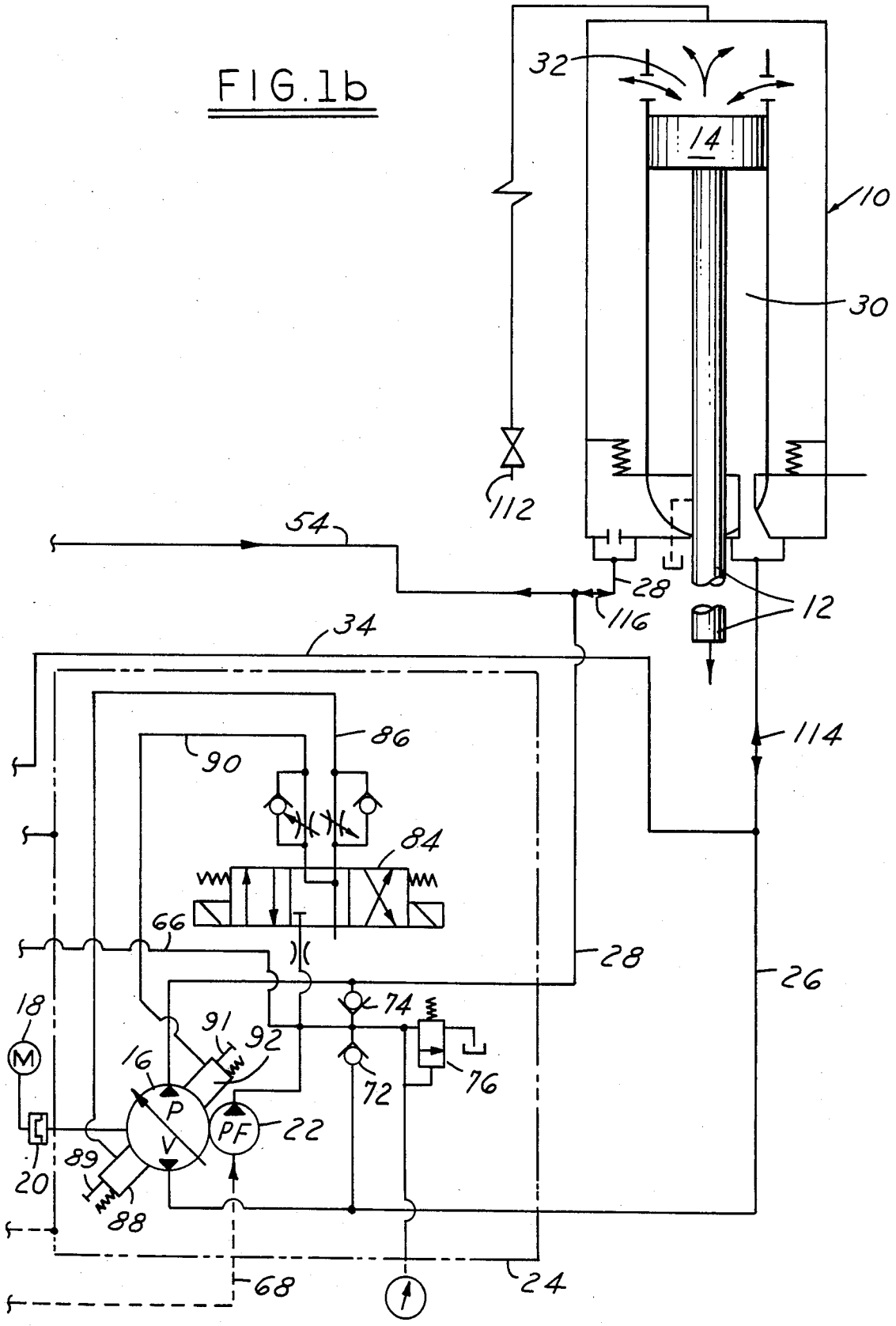

Illustrated in FIGS. 1*a* and 1*b* is the hydraulic schematic for the oil well lift pump with the energy storing flywheel pump/motor combination. The basic lift pump comprises a well cylinder generally denoted by 10 that is suspended directly above the well pipe (not shown). The piston rod 12 of the well cylinder 10 is directly connected to the pump rod of the well. Reciprocating vertical movement of the well cylinder piston 14 and rod 12 causes the pumping action for lifting the oil from the well. Pressurized hydraulic fluid for operating the well cylinder 10 is provided by a variable volume swash plate type hydraulic pump 16 which in turn is driven mechanically by a natural gas or diesel engine identified by 18 through a mechanical coupling 20. The pump 16 may also be driven by an electric motor where electric power is conveniently available and more economical. A suitable pump 16 is the Sunstrand Model No. 20-2057 pump equipped with a charging pump indicated at 22. The pump 16 with attached valving and other hydraulic control is typically mounted on a skid with a sump indicated by the line 24. The pump 16 supplies high pressure fluid through conduit 26 and receives low pressure return fluid through conduit 28. As shown, these conduits are directly connected respectively to the high pressure piston rod side 30 and low pressure cylinder side 32 of the well cylinder 10.

Figure 2:
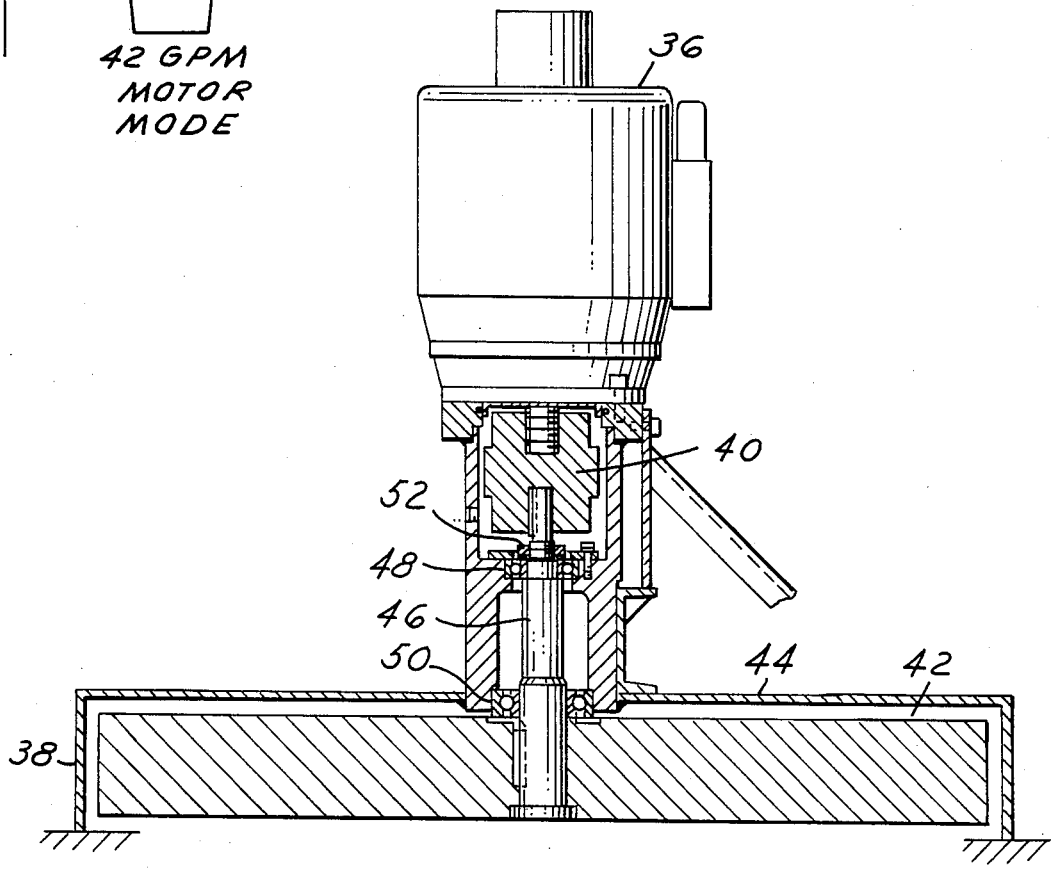
FIG. 2 is a partial cutaway of a combined pump/motor and flywheel assembly.

A second high pressure conduit 34 is in communication with the first high pressure conduit 26 and a second swash plate pump/motor 36 mounted on a second pallet and sump 38. Hydraulic pump/motor 36 is mechanically coupled 40 to a flywheel 42. A suitable physical configuration for the pump/motor 36, coupling 40 and flywheel 42 is illustrated in FIG. 2 wherein the pump-/motor 36 is mounted to the deck 44 of the pallet 38 and the flywheel 42 is suspended on a vertical shaft 46 in turn supported in bearings 48 and 50. Bearing 48 by means of threaded collar 52 supports the flywheel 42. A suitable swash plate pump/motor is the Sunstrand Model 22-2084 pump. The pump/motor and flywheel combination could also be mounted horizontally.

Returning to FIGS. 1*a* and 1*b*, the low pressure return line 54 to the pump/motor 36 communicates with the low pressure conduit 28 from the well cylinder 10. The fluid circuits described above comprise the basic circuitry required for raising and lowering the well cylinder rod 12 and pump rod for the oil well. As an example, the pressure in conduits 26 and 34 during the lifting stroke is approximately 2,000 lbs. per square inch and during the return stroke approximately 1,200 lbs. per square inch. The return conduits 54 and 28 are operated typically at approximately 150 lbs. per square inch. The relief valve 56, providing communication between the high pressure conduit 34 and the return conduit 54, is typically set at 3,000 lbs. per square inch to act as a safety valve. The relief valve 58 communicating between the return conduit 54 and the drain or sump is typically set at 150 lbs. per square inch.

The balance of the fluid circuitry provides for pilot control of pump/motor 36 and pump 22, charging of the fluid circuitry and other fluid supply functions. At the top of FIG. 1*a* is illustrated a reservoir tank 60. Hydraulic fluid is supplied from the reservoir 60 through a shutoff valve 62 to a filter 64 and supply line in turn communicating with charging pump 22. At start up charging pump 22 initially provides fluid to high pressure conduit 26 and return conduit 28 through the check valves 72 and 74, respectively. Pressure relief valve 76 is typically set at 210 lbs. per square inch. The pump/motor 36, being in communication with conduits 26 an 28 through conduits 34 and 54 respectively is also provided with fluid.

With the high pressure and return circuits filled, solenoid operated 3-way valve 84 can be shifted to the pump on position causing flow from charging pump 22 to pass through pilot line 86 to actuate pump servo 88 thereby moving the swash plate of the pump 16 into a pumping mode and supplying fluid at high pressure to conduit 26. Solenoid actuation of the valve 84 to the opposite position provides flow from the charging pump 22 through pilot line 90 to the opposite servo 92 on the pump 16 thereby moving the swash plate to the non-pumping mode. Either manually or automatically adjustable limit stops 89 and 91 are provided on the pump 16 to set the pump displacement per revolution in the non-pump mode and pump mode. Typically, the valve 84 can be operated manually or automatically in a conventional manner. Thus, the supply of high pressure fluid per unit time can be adjustably set for the pump 16 in either mode.

FIG. 5 illustrates a hydraulic automatically adjustable limit stop 101. A small hydraulic actuator 78 moves the limit stop 101 in response to the setting of the electrically actuated reversing valve 70. Valve 70 is supplied with hydraulic fluid by the charging pump 22 through conduit 66. As an alternative an electric motor driven ball screw might be substituted for linear movement of the limit stop 101. The above automatically adjustable limit stop actuator might be substituted for any of the other limit stops 89, 91 or 99, however, automatic positioning of limit stop 101 to intermediate positions has a two fold purpose as described below.

Charging pump 22 supplies pilot flow through conduit 66 and 3-way solenoid valve 94 to either of a pair of pilot lines 96 and 98 in turn communicating with servos 100 and 102 that control the swash plate of pump/motor 36. In the motor mode for accelerating the rotational speed of the flywheel 42, the supply of fluid from charging pump 22 passes through pilot line 98 to servo 102. In the pumping mode for pump/motor 36, charging pump 22 provides fluid to pilot line 96 in communication with servo 100. Either manually or automatically adjustable limit stops 99 and 101 are provided on the pump/motor 36 to set the displacement per revolution in the pump mode and motor mode. Thus, the supply of high pressure fluid per unit time can be adjustably set for the pump mode and the motor mode of the pump/motor 36. If fluid pressure is not supplied to either servo 100 or 102, the swash plate of pump/motor 36 is substantially centered and no displacement per revolution occurs.

The sump or drain lines 104 are connected to a temperature sensor and switch 106 which in turn controls a valve 108 and cooler 110 to cool overheated fluid when necessary as it is returned to the reservoir 60. Connected to the well cylinder is a vent at 112 to bleed air and fluid from the well cylinder as necessary when charging the system.

Figure 3:
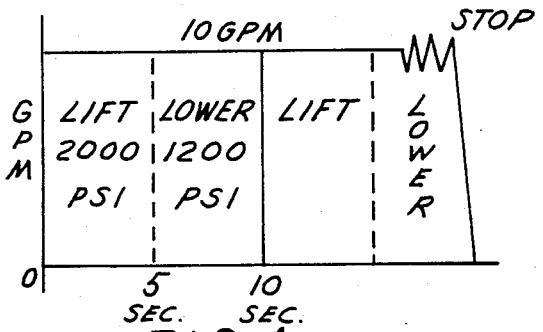
FIG. 3 is a schematic graph of flow versus time for the diesel engine driven pump.
Figure 4:
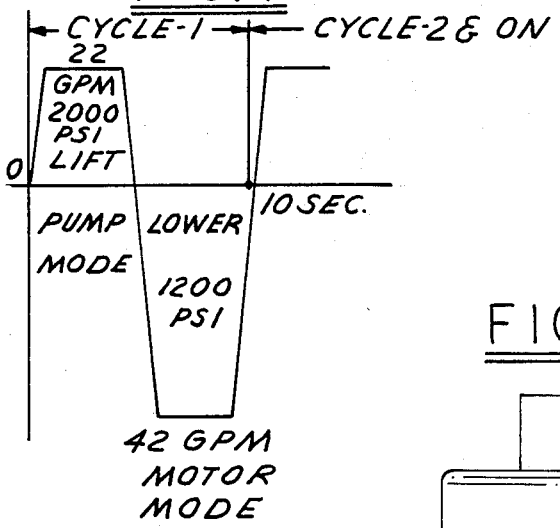
FIG. 4 is a schematic graph of flow versus time for the combined pump/motor connected to the flywheel.

FIG. 3 illustrates the flow rate versus pressure in the high pressure conduits 26 and 34 as the well cylinder cycles from lifting to lowering the piston rod 12 and pump rod. As indicated by the arrow 114 in FIG. 1, the fluid cycles back and forth at a rate of about 32 gallons per minute with a pressure that oscillates between 2,000 lbs. per square inch and 1,200 lbs. per square inch. Referring to FIG. 4 for the pump/motor 36 in the pumping mode, 22 gallons per minute at 2,000 lbs. per square inch are provided to assist in lifting the well cylinder piston 14, piston rod 12 and pump rod, the energy being provided by the decelerating flywheel 42. In the return stroke of the well cylinder 10, the pump/motor is shifted to the motor mode and 1,200 lbs. per square inch fluid is provided at the rate of 42 gallons per minute through circuit 34 to the pump/motor 36 to thereby accelerate the flywheel 42. Thus, the flywheel 42 absorbs a portion of the energy stored in the column of oil and pump rod from the previous lift and which is represented by the area identified as "LOWER" in FIG. 4. The flywheel 42 then releases the energy stored from the lowering stroke, the energy being identified as the area under the curve in FIG. 4 designated "LIFT". The areas are not equal in size because of the inherent energy loss of the fluid and mechanical system. This energy loss is of course made up by the energy input from the diesel or gas engine 18 and pump 16. The pump 16 may operate in a pumping mode or a neutral mode during the lowering portion of the well cylinder cycle as follows.

In normal operation the pump 16 and pump/motor 36 both provide fluid at 2000 pounds per square inch through conduits 26 and 34 to the well cylinder 10 on the lifting stroke. The limit stops 91 and 99 determine the flow rate and therefore in combination the lift stroke time. On the return stroke the pump/motor 36 shifts to motor mode at a fluid flow rate set by limit stop 101, normally 42 gallons per minute, and the pump 16 continues to supply fluid to conduit 26. However, both the flow from the well cylinder 10 and from the pump 16 supply fluid at 1200 pounds per square inch to the pump/motor 36. The automatically adjustable limit stop 101 determines the rate at which the flywheel increases in speed and therefore the rate at which the well cylinder piston 14 and pump rod 12 fall on the return stroke. The time for the return stroke is adjusted in this manner to both prevent the pump rod and driven piston from the free falling and to assure that the driven piston valve admits a full charge of crude oil on each stroke. Thus, shock loading of the pump rod, driven piston and well cylinder can be avoided merely by properly setting the limit stop 101 to provide smooth reciprocation of the well cylinder piston 14.

The limit stop 101 is also used to prevent over speeding of the flywheel 42 by a combined intermediate setting of the limit stop 101 with limit stop 89. As the flywheel approaches a limiting speed such as 3000 RPM, the pump 16 is shifted to a non-pumping mode as set by limit stop 89 and limit stop 101 is adjusted to an intermediate position. Without the fluid supply from the pump 16 and with the pump/motor 36 displacement in the motor mode lowered to about 32 gallons per minute, the pump rod 12 and well cylinder piston 14 are prevented from increasing their rate of fall on the return stroke and the flywheel prevented from over speeding.

Although the flywheel pump/motor energy storage device disclosed above is disclosed in combination with a hydraulic oil well pump, the device is applicable to other hydraulic equipment wherein a substantial mass is reciprocated vertically. On board floating derricks and ocean drill ships wherein hydraulic heave accummulators are utilized to control the elevation of derrick loads, risers and drill strings, the potential energy stored as the derrick or ship lifts on ocean swells can be partially captured to assist in the operation of the heave accummulators or otherwise to reduce the need for energy to operate on board hydraulic equipment.

I claim:

1. An energy storable source and sink for high pressure hydraulic fluid comprising, high pressure hydraulic fluid input/output supply means and low pressure hydraulic fluid input/output supply means, a hydraulic pump communicating between the high pressure supply means and the low pressure supply means, a hydraulic pump/motor communicating between the high pressure supply means and the low pressure supply means, said pump/motor being connected between the two supply means in parallel with the pump, pump control means connected to the pump and adapted to selectably cause the pump to provide high pressure fluid to the high pressure supply means, pump/motor control means connected to the pump-/motor and adapted to selectably cause the pump-/motor to provide high pressure fluid to the high pressure supply means or to accept high pressure fluid from the supply means, and a rotatable mass, a rotatable shaft connected to said rotatable mass, said rotatable shaft mechanically connected to said pump/motor in driving engagement therewith.

2. The energy storable source and sink of claim 1 wherein said pump comprises a variable flow pump.

3. The energy storable source and sink of claim 1 wherein said pump/motor comprises a variable flow pump/motor.

4. The energy storable source and sink of claim 3 wherein said pump/motor control means includes means to change the fluid flow rate through said pump-/motor in response to a change in fluid flow through the pump.

5. An energy storing well lift pump comprising, hydraulic well lift means generally positionable above a well head and attachable to a pump rod extending downwardly into the well for vertical reciprocating movement of the pump rod, high pressure hydraulic fluid input/output supply means in communication with the well lift means and low pressure hydraulic fluid input/output supply means in communication with the well lift means, a hydraulic pump communicating between the high pressure supply means and the low pressure supply means, a hydraulic pump/motor communicating between the high pressure supply means and the low pressure supply means, said pump-motor being connected between the two supply means in parallel with the pump, pump control means connected to the pump and adapted to selectably cause the pump to provide high pressure fluid to the high pressure supply means, pump/motor control means connected to the pump-/motor and adapted to selectably cause the pump-/motor to provide high pressure fluid to the high pressure supply means or to accept high pressure fluid from the supply means, and a rotatable mass, a rotatable shaft connected to said rotatable mass, said rotatable shaft mechanically connected to said pump/motor in driving engagement therewith.

6. The energy storing well lift pump of claim 5 wherein said hydraulic pump comprises a variable flow pump having variable flow control servos thereon and said pump control means comprises a source of pressurized fluid, pilot conduit means connecting the source of pressurized fluid to the pump control servos and valve means interposed in the pilot conduit means to selectably actuate the pump control servos.

7. The energy storing well lift pump of claim 5 wherein said hydraulic pump/motor comprises a variable flow pump/motor having variable flow control servos thereon and said pump/motor control means comprises a source of pressurized fluid, pilot conduit means connecting the source of pressurized fluid to the pump/motor control servos and valve means interposed in the pilot conduit means to selectably actuate the pump/motor control servos.

8. The energy storing well lift pump of claim 5 wherein said well lift means comprises a hydraulic cylinder vertically mountable above a well head with the pump rod actuatable by the piston of the hydraulic cylinder.

* * * * *